US009617124B2

(12) United States Patent
Grapengiesser

(10) Patent No.: US 9,617,124 B2
(45) Date of Patent: Apr. 11, 2017

(54) CRANE

(71) Applicant: APM Terminals BV, The Hague (NL)

(72) Inventor: Volker Grapengiesser, Uetersen (DE)

(73) Assignee: APM TERMINALS BV, The Hague (NL)

( * ) Notice: Subject to any disclaimer, the term of this patent is extended or adjusted under 35 U.S.C. 154(b) by 0 days.

(21) Appl. No.: 14/361,224

(22) PCT Filed: Nov. 26, 2012

(86) PCT No.: PCT/EP2012/073607

§ 371 (c)(1),
(2) Date: May 28, 2014

(87) PCT Pub. No.: WO2013/079439

PCT Pub. Date: Jun. 6, 2013

(65) Prior Publication Data

US 2014/0332489 A1 Nov. 13, 2014

Related U.S. Application Data

(60) Provisional application No. 61/564,638, filed on Nov. 29, 2011.

(30) Foreign Application Priority Data

Nov. 29, 2011 (DK) ..... 2011 70658

(51) Int. Cl.
*B66C 19/00* (2006.01)

(52) U.S. Cl.
CPC ..... *B66C 19/002* (2013.01)

(58) Field of Classification Search
CPC ..... B16C 19/002; B16C 17/00; B16C 17/20
See application file for complete search history.

(56) References Cited

U.S. PATENT DOCUMENTS 660,031 A 10/1900 Seaver
756,932 A 4/1904 Browning
(Continued)

FOREIGN PATENT DOCUMENTS

CN 1764593 A 4/2006
CN 200988740 Y 12/2007
(Continued)

OTHER PUBLICATIONS

International Search Report and Written Opinion for PCT:EP2012:073607, mailed Jan. 16, 2013.
(Continued)

*Primary Examiner* — Emmanuel M Marcelo
*Assistant Examiner* — Justin Stefanon
(74) *Attorney, Agent, or Firm* — Brinks Gilson & Lione

(57) ABSTRACT

A cargo crane (1) for transferring containers (50) to and from a ship (100) birthed alongside a quay (110) is disclosed. The cargo crane (1) includes: at least one quayside support leg (10) supported by a bogie (60) arranged to travel on a rail, at least one landside support leg (20) supported by a bogie (60) arranged to travel on a rail, a boom (2) configured to extend over a ship (100) birthed alongside a quay (110), a trolley (3) displaceably connected to said boom (2), and container lifting means (5) connected to said trolley (3) The invention is novel and inventive in that said at least one quayside support leg (10) in a first height define an outer horizontal width (A) and, in a second height, said at least one quayside support leg (10) define an inner horizontal width (B') wherein said inner horizontal width (B') in said second height is greater or less than said outer horizontal width (A) of said quayside support leg (10) in said first height.

20 Claims, 3 Drawing Sheets

(56) References Cited

U.S. PATENT DOCUMENTS

| | | | | |
|---|---|---|---|---|
| 1,079,519 | A | 11/1913 | Sawyer | |
| 1,111,100 | A | 9/1914 | Sawyer | |
| 1,305,802 | A | 6/1919 | Hulett | |
| 1,373,464 | A | 4/1921 | Titcomb | |
| 1,436,861 | A | 11/1922 | Collins | |
| 1,547,536 | A | 7/1925 | Der et al. | |
| 3,414,143 | A * | 12/1968 | Scott | B66C 7/00 212/325 |
| 3,630,390 | A | 12/1971 | Tax et al. | |
| 3,881,608 | A | 5/1975 | Hupkes | |
| 4,435,118 | A | 3/1984 | Behrend et al. | |
| 4,569,453 | A | 2/1986 | Oustad | |
| 5,775,866 | A * | 7/1998 | Tax | B66C 19/002 212/316 |
| 5,788,096 | A | 8/1998 | Wilcox | |
| 5,951,226 | A | 9/1999 | Fantuzzi | |
| 6,530,492 | B2 * | 3/2003 | Weis | B66C 19/002 212/316 |
| 6,694,215 | B1 * | 2/2004 | Kwon | B65G 63/004 700/213 |
| 6,698,990 | B1 | 3/2004 | Dobner et al. | |
| 7,370,768 | B2 * | 5/2008 | Chattey | B66C 19/002 212/270 |
| 7,455,492 | B2 * | 11/2008 | Weis | B66C 19/002 104/98 |
| 7,523,836 | B2 * | 4/2009 | Larsen | B66C 19/002 212/312 |
| 7,762,760 | B2 * | 7/2010 | Takehara | B65G 63/004 212/325 |
| 8,225,948 | B2 * | 7/2012 | De Jong | B66C 19/002 212/316 |
| 2002/0031419 | A1 | 3/2002 | Weis | |
| 2003/0077149 | A1 | 4/2003 | Dobner et al. | |
| 2006/0104748 | A1 | 5/2006 | Jeong | |
| 2006/0182524 | A1 | 8/2006 | Franzen et al. | |
| 2006/0182526 | A1 | 8/2006 | Weis | |
| 2008/0213073 | A1 | 9/2008 | Benedict et al. | |
| 2008/0219804 | A1 * | 9/2008 | Chattey | B66C 19/002 414/140.3 |
| 2008/0264889 | A1 | 10/2008 | Larsen | |
| 2009/0191028 | A1 | 7/2009 | Tian | |
| 2009/0208312 | A1 * | 8/2009 | De Jong | B66C 19/002 414/140.3 |
| 2010/0239402 | A1 | 9/2010 | Holmedal | |

FOREIGN PATENT DOCUMENTS

| | | | |
|---|---|---|---|
| CN | 101472816 | A | 7/2009 |
| DE | 19528555 | A1 | 2/1997 |
| DE | 19703282 | A1 | 8/1998 |
| DE | 19703284 | A1 | 8/1998 |
| DE | 19803322 | A1 | 8/1998 |
| EP | 0318264 | | 5/1989 |
| EP | 0318264 | A1 | 5/1989 |
| EP | 0790955 | B1 | 7/1999 |
| EP | 0879785 | A2 | 11/1999 |
| EP | 1264789 | A1 | 12/2002 |
| EP | 1923338 | A1 | 5/2008 |
| EP | 2540654 | A1 | 1/2013 |
| GB | 968838 | A | 9/1964 |
| JP | 60026598 | A | 2/1985 |
| JP | H05338991 | | 12/1993 |
| JP | 7137981 | A1 | 5/1995 |
| JP | 2001192197 | A | 7/2001 |
| JP | 2003292166 | | 10/2003 |
| JP | 2010235274 | A | 10/2010 |
| JP | 2012201478 | | 10/2012 |
| KR | 20030017070 | A | 3/2003 |
| KR | 20110049144 | A | 5/2011 |
| RU | 1796570 | A1 | 2/1993 |
| SU | 523033 | A1 | 7/1976 |
| WO | 0125131 | A1 | 4/2001 |
| WO | 2004022474 | A1 | 3/2004 |
| WO | 2005012149 | A1 | 2/2005 |
| WO | 2005014450 | A | 2/2005 |
| WO | 2005021414 | A | 3/2005 |
| WO | 2008058763 | A1 | 5/2008 |
| WO | 2008115966 | A1 | 9/2008 |
| WO | 2010113704 | A1 | 10/2010 |

OTHER PUBLICATIONS

European Office Action for Application No. 12794285.2, dated Jun. 10, 2015.

Office Action for Chinese Application No. 201280058327.3, Mailed Jul. 31, 2015.

Office Action for Russian Applicaion No. 2014126402, Date Aug. 11, 2016.

* cited by examiner

CRANE

RELATED APPLICATIONS

This application claims the benefit under 35 U.S.C. §371 of International Application No. PCT/EP2012/073607, having an International Filing Date of Nov. 26, 2012, which claims priority to Danish Application No. PA 2011 70658, filed Nov. 29, 2011, and U.S. Provisional Application No. 61/564,638, filed Nov. 29, 2011, the contents of both of which are incorporated herein by reference in their entirety.

According to a first aspect, the present invention relates to a cargo crane configured for transferring containers to and from a ship birthed alongside a quay.

According to a second aspect, the present invention relates to a set of cargo cranes configured for transferring containers to and from a ship birthed alongside a quay.

The expression "quay" throughout this specification denotes a structure of solid construction along a shore or bank that provides berthing for a ship and generally provides cargo handling facilities e.g. for cranes.

The cargo crane according the first aspect of the present invention, which may be of the type generally known as "Ship To Shore" crane, or simply STS-crane, includes:

- at least one quayside support leg supported by a bogie arranged to travel on a rail,
- at least one landside support leg supported by a bogie arranged to travel on a rail,
- a boom configured to extend over a ship birthed alongside a quay,
- a trolley displaceably connected to the boom, and
- container lifting means connected to the trolley.

Container cranes such as a ship to shore cranes typically constitute large dockside gantry cranes arranged at container terminals for loading and unloading intermodal containers from container ships. Container cranes consist of a supporting framework that can traverse the length of a quay or yard, and a moving platform generally called a spreader. The spreader can be lowered down on top of a container and locks on to the container's four locking points using a twist lock mechanism. Cranes normally transport a single container at once; however some recent cranes have the capability to pickup either two 40-foot containers or up to four 20-foot containers at once.

BACKGROUND

Owners and operators of containerships strive in optimizing every aspect of transport of containers while minimizing costs and environmental impacts.

One relative new proposal for optimization is to reduce the service speed of large containerships significantly whereby fuel consumption is reduced likewise significantly. In order to make up for some of the time lost during sailing, owners and operators now urge container handling facilities, or container terminals, to operate even faster.

The container handling capacity, or the performance, of container terminals using ship to shore cranes are limited by the fact that the ship to shore cranes can, due to their width, work at alternate bays of a container ship only, i.e. every second hatch of the ship is left idle without a crane.

The minimum centre distance between two of today's ship to shore cranes is about 27 m. As the centre distance between container holds of modern container ship is in the range of 15 meters only, leaving every second hatch of the ship idle, or unserviced, while loading or unloading containers, is generally accepted for the reason that this drawback simply cannot be overcome by means of today's cranes.

EP 0318264 A discloses a travelling container crane including a mobile gantry configured for sideways movement on fixed ground rails. The crane includes two parallel spaced-apart beams supported by, and extending horizontally from, the gantry in a direction perpendicular to the direction of motion of the gantry. A mobile trolley is supported under each beam and on rails fixed to the beam for to-and-from movement of the trolley along the beam. Hoist able container lifting means is suspended from each trolley. In a preferred embodiment, the third mobile trolley and the associated container-lifting device is supported between the two beams on further rails fixed to the two beams. By this, the third trolley may move along the space between the beams on the said further rails. Summarizing, the crane according to EP 0318264 A discloses a crane with a very wide portal allowing for two or more trolleys operating within the portal.

WO2008/058763 A1 discloses a high performance crane for transferring cargo to and from a ship. The crane include a boom and a trolley where the boom extends essentially perpendicular to a longitudinal rail arranged on the quay such that one end of the boom extends over the ship. The trolley is displaceably connected to a transverse rail of the boom and the trolley includes a lifting device for lifting a load or a group of loads.

BRIEF DESCRIPTION OF THE INVENTION

It is an object of the present invention to set forth a crane, or a set of cranes, which enables a container terminal to significantly decrease the required time for loading and unloading containers present on board a containership. In particular, it is an object of the present invention to set forth a container crane, or a set of container cranes, allowing for loading and unloading of neighbouring container holds of a containership.

According to the present invention, the above object may be met by the provision of a crane, or a set of cranes, as per the introductory part of this specification wherein least one quayside support leg, in a first height, define an outer horizontal width and, in a second height lying above or below the first height, the at least one quayside support leg define an inner horizontal width wherein the inner horizontal width in the second height is greater than the outer horizontal width of the quayside support leg in the first height.

Likewise, in accordance with the present invention, the above object may be met by the provision of a crane, or a set of cranes, as per the introductory part of this specification wherein least one quayside support leg, in a first height, define an outer horizontal width and, in a second height lying above or below the first height, the at least one quayside support leg define an inner horizontal width wherein the inner horizontal width in the second height is less than the outer horizontal width of the quayside support leg in the first height.

The effect of configuring the at least one quayside support leg as per the above is that 40 or 45 foot containers may move essentially perpendicular to and from a container hold of a containership free of hindrances caused e.g. by legs or support structures of prior art cranes. In particular, when two neighbouring container cranes loads or unloads containers in two neighbouring container holds, the effect is evident.

According to one embodiment, the container lifting means, the trolley and the boom may be configured to transfer containers to or from a ship by means of passing the containers over a portion of the at least one quayside support leg. The portion of the at least one quayside support leg may lie immediately, or vertically, below the path of container transfer.

According to one embodiment, the at least one quayside support leg may define an opening allowing for long side passage of a container. The size of the opening may be configured to allow passage of a 45 foot container of 13.72 m while maintaining a clearance of about 0.4 m in all directions. Further it may be preferred to configure the opening to allow for diagonal passage of a 45 foot container, i.e. the passageway may have a longitudinal opening of at least 14.75 m. Furthermore, the height of the opening may be configured such that the container incl. optional spreader etc. is ample to secure passage.

According to one embodiment, the quayside support leg may constitute a pair of quayside supporting legs.

According to one embodiment, the at least one quayside support leg and the at least one landside support leg may be arranged to travel on rails by means of bogies.

According to one embodiment, the least one landside support leg may be arranged to travel on an elevated rail by means of at least one bogie. The elevated rail may be elevated to a height allowing for passage of cargo vehicles carrying cargo underneath the elevated rail. This allows for, in case the landside legs of several cranes are positioned closely together and thereby obstructing traffic to and from the landside handling area in-between the legs of the cranes, easy transfer of containers between the cranes and container terminal facility.

The free height for passage below the landside rail may be in the range of 17 m. The horizontal distance between vertical crane rail supports may be minimum 30 m. Consequently, truck heads with chassis, straddle carriers or automated vehicles may enter the area below the crane at essentially any location greatly reducing congestion under the cranes.

According to one embodiment, the present invention may take the form of a set of cargo cranes where, in a first crane, the quayside support leg may define an opening allowing for long side passage of a container in a first height. In a second crane, the quayside support leg may define an opening allowing for long side passage of a container in a second height. The first height and the second height may be chosen such that the set of cargo cranes may approximate each other such that the set of cargo cranes are able to simultaneously transfer containers to and from two neighbouring container holds of a containership. This prevents that, when the set of cranes are closely positioned such as when loading and unloading containers to or from two neighbouring container holds, the support leg or legs of one crane block or obstruct free transfer of a container handled by the neighbouring crane.

According to one embodiment, the distance between boom centre lines of a first cargo crane and a second cargo crane may be less than 14 meters, alternatively less than longitudinal centre distances of a containerships cargo holds.

According to one embodiment, the openings in the quayside supporting legs of the set of cranes may define passageways for containers wherein a container passing through the opening of the first crane is passed over a portion of the quayside support leg of the second crane and optionally vice versa.

According to one embodiment, the landside support legs and the quayside support legs of each of the cranes may be, by means of bogies, arranged to travel on a total of four dedicated rails extending substantially parallel to the quay. This allows for one crane being able to travel behind another crane such that the quayside and/or support legs of the cranes may overlap.

According to one embodiment, the landside support legs of the set of cranes may be configured to travel on a rail elevated to a height allowing for passage of cargo vehicles carrying cargo underneath the elevated rail.

According to one embodiment, the container mentioned may be 40 or 45 foot container of the ISO height of 8'6" and/or high cube height of 9'6".

DETAILED DESCRIPTION OF THE INVENTION WITH REFERENCE TO THE FIGURES

Figure 1:
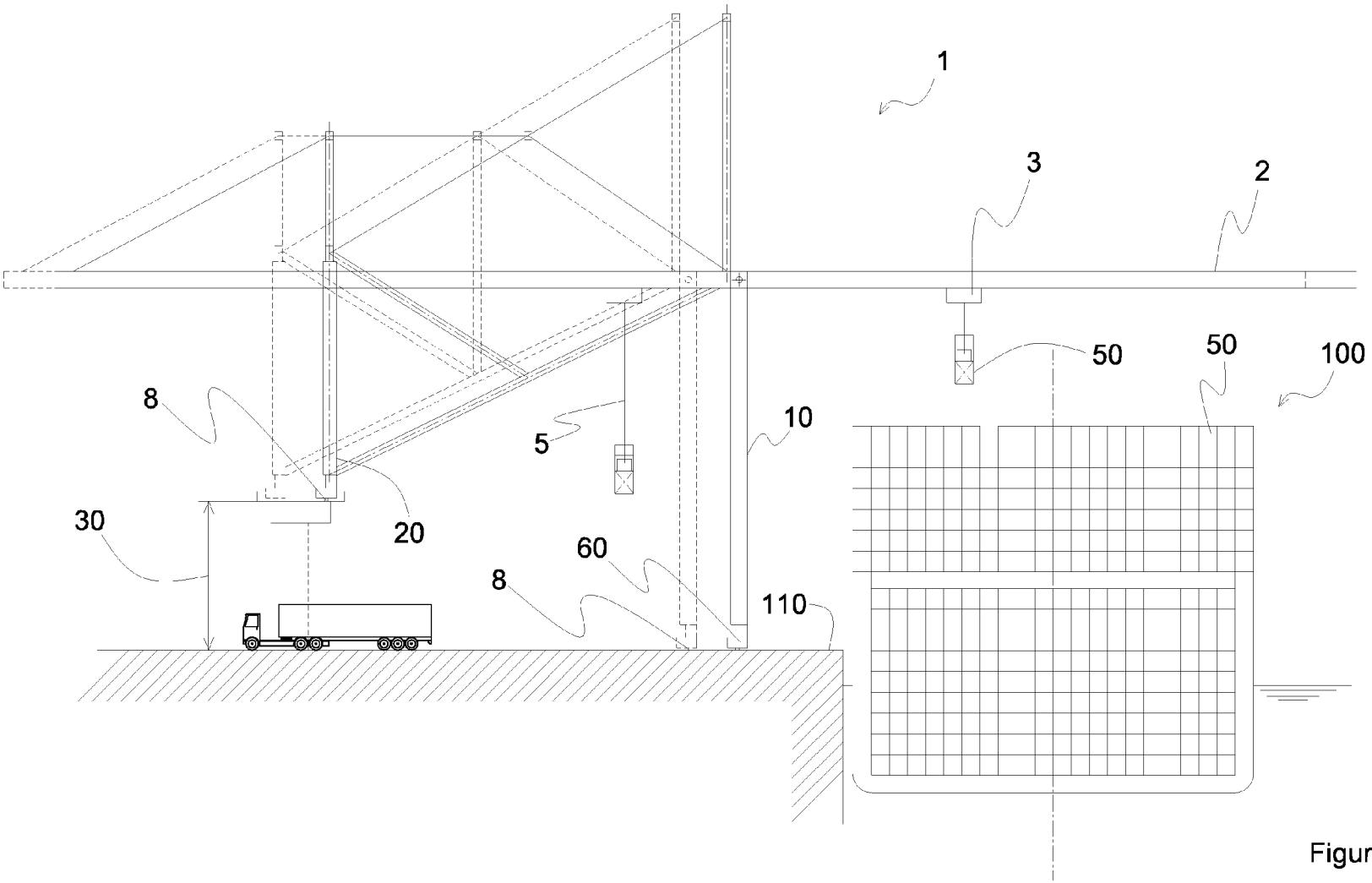
FIG. 1 illustrates a principal side view of two cranes one of which carrying a container above a ship berthed alongside a quay.

FIG. 1 illustrates a principal side view of two cranes one of which carrying a container 50 above a ship 100 berthed alongside a quay 110. For illustrative purposes, one crane is shown in broken lines.

As can be seen in the figure, the two cranes are configured to move along four vaguely illustrated tracks 8 all of which are arranged essentially parallel to the ship 100 and to the quay 110.

The quayside support legs 10 of the cranes are configured to move on tracks 8 arranged essentially in level with the quay 110, and the landside support legs 20 are, in the illustrated embodiment, configured to move on elevated rails 8.

Elevating the landside tracks as shown in the figure greatly facilitate traffic to and from the cranes landside handling area.

The landside crane rails 8 and/or the quay side crane rails 8 for the crane shown in solid lines may, as can be seen, be offset a distance e.g. of 3.5 m with respect to the crane shown in broken lines. By this, the support legs of the cranes may partially pass each other. This allows the cranes to proximate each other until a centre to centre distance of the cranes in the range of 13.2 m is obtained although the each of the cranes incl. bogies 60 has a width in the range of 26.4 m. The width of the support leg structures may, despite the narrow centre to centre distance of the cranes, be in the range of 23.6 m for one crane and 19.6 m for crane another crane.

In order to obtain sufficient wind stability, the crane according to the present invention also benefit from the abovementioned double sets of crane rails at the landside and at the quayside respectively as the bogies 60 extend beyond the supporting legs of the cranes.

The distance between the supporting legs of a set of cranes, in the direction perpendicular to the crane rails, may be in the range of 1 m.

Figure 2:
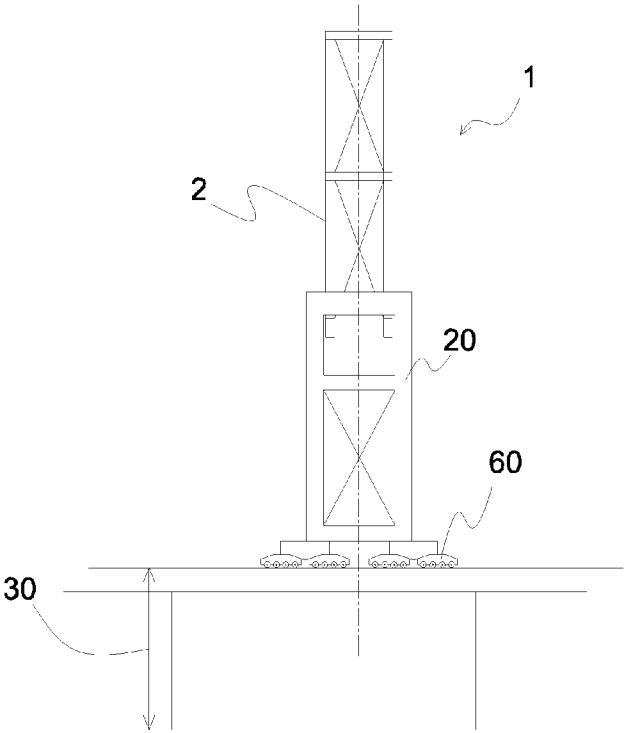
FIG. 2 shows a crane including the landside supporting leg of a crane according to the present invention.

FIG. 2 shows a landside supporting leg 20 of one embodiment of a crane according to the present invention. Again, the illustrated embodiment discloses a crane configured to move along an elevated landside track or rail.

The crane or the set of cranes, according to the present invention may, although not shown in the figures, be configured to operate on quayside rails and landside rails arranged in essentially corresponding heights.

Figure 3:
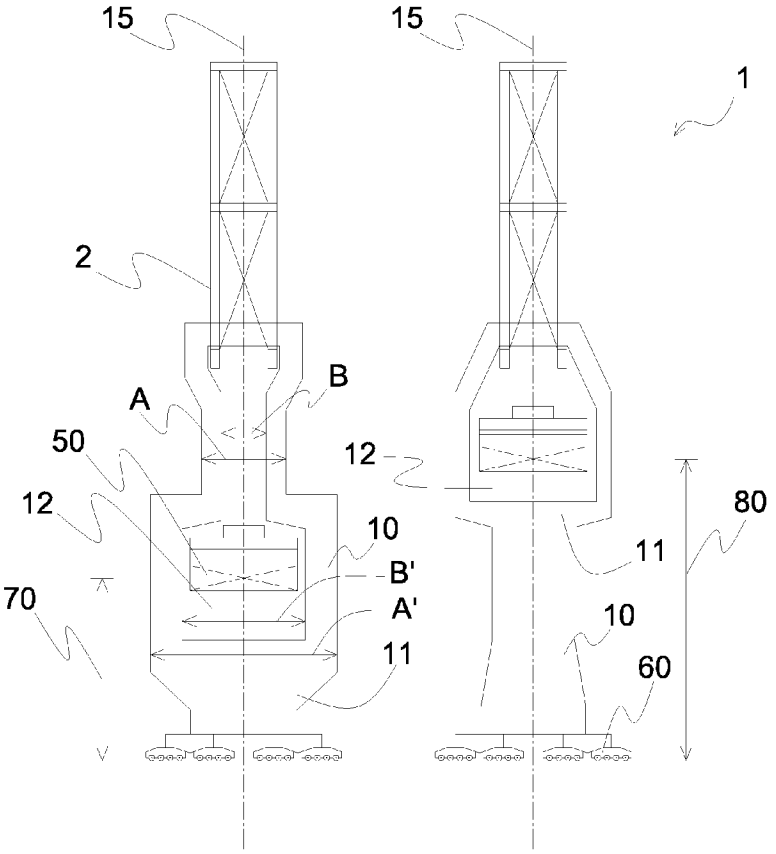
FIG. 3 shows a quayside view of two cranes according to the present invention.

FIG. 3 shows a quayside view of a set of a set of cranes according to the second aspect of the present invention. As can be seen, the openings 12, or transfer openings 12, are arranged in different heights 70, 80.

Figure 4:
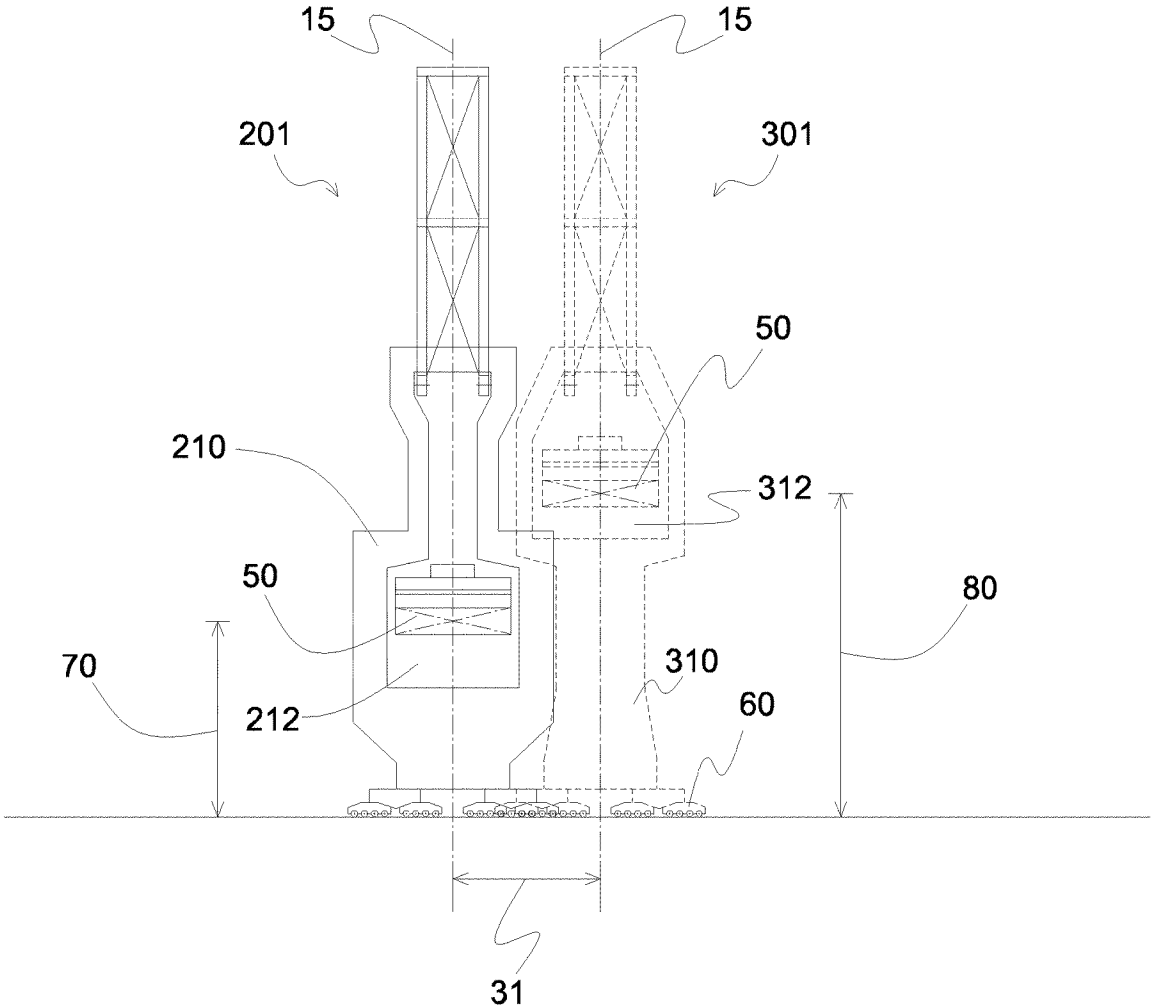
FIG. 4 shows a quayside view of a set of cranes according to the present invention.

FIG. 4 shows a quayside view of a set of cranes according to FIG. 3, however here, the cranes are positioned closely together. Also here, one crane is, for illustrative purposes, shown in broken lines.

In accordance with the invention, the cranes may be configured to operate closely together with centre line 15 distances of about 13.5 m to leave no bay of a ship 100 idle.

The opening 12, 212, 312, preferably is configured to allow long side passage of 45 foot containers. 45 foot containers have a length of 13.72 m. As the spreader incl. the remaining means for lifting the container under certain scenarios cause a container to move irregularly, the opening 12, 212, 312 preferably is configured to allow for passage of a 45 foot container oriented diagonally whereby the length, measured parallel to the quay, of the container may be e.g. 13.95 m.

A clearance of minimum of 0.4 m on each side of the passage for the container is considered sufficient, hence the opening 12, 212, 312 should be at least 14.75 m.

14.75 m opening is also sufficient for the passage of hatch covers of the ships' container holds.

As per the above, the quayside support legs of a set of cranes may be embodied with different designs. A first crane having a first quayside support leg may be provided with a wide opening arranged essentially in the middle of the support leg. A second crane may be provided with a wide opening arranged at the top of its support leg. The set or pair of cranes cannot have a wide passage overall the supporting legs of neighbouring cranes will obstruct transfer of containers.

The upper part of the crane according to the present invention may equate to that of a conventional crane configured for single or dual hoist operation etc.

The crane or the set of cranes according to the present invention may be provided with anti-sway means as well as automatic hoist+trolley operation. The operation may be carried out by means of a processor and software configured to prevent collision of cargo or spreader flippers with the quayside supports.

As the quay load increases, it is foreseen that reinforced quay walls in some sites of application may be required.

In summary, the crane concept as disclosed herein allows for doubling the berth capacity of container terminal facilities by the provision of a cargo crane, or a set of cargo cranes, configured for transferring containers to and from a ship birthed alongside a quay. The cargo crane, or the set of cargo cranes, includes:

- at least one quayside support leg supported by a bogie arranged to travel on a rail,
- at least one landside support leg supported by a bogie arranged to travel on a rail,
- a boom configured to extend over a ship birthed alongside a quay,
- a trolley displace ably connected to said boom, and
- container lifting means connected to said trolley.

The invention is novel and inventive in that said at least one quayside support leg in a first height define an outer horizontal width (A) and, in a second height, said at least one quayside support leg define an inner horizontal width (B') wherein said inner horizontal width (B') in said second height is greater or less than said outer horizontal width (A) of said quayside support leg in said first height.

The application and combination of features and solutions presented by the present invention is not limited to the presented embodiments. One or more features of one embodiment can and may be combined with one or more features of other embodiments, whereby not described but valid, embodiments of the present invention may be obtained.

The term "comprises/comprising/comprised of" when used in this specification incl. claims is taken to specify the presence of stated features, integers, steps or components but does not preclude the presence or addition of one or more other features, integers, steps, components or groups thereof.

The invention claimed is:

1. A cargo crane for transferring containers to and from a ship birthed alongside a quay, said cargo crane includes:

- at least one quayside support leg directly supported by a bogie arranged to travel on a rail,
- at least one landside support leg directly supported by a bogie arranged to travel on a rail,
- a boom configured to extend over a ship birthed alongside a quay,
- a trolley displaceably connected to said boom, and
- container lifting means connected to said trolley
- wherein said at least one quayside support leg in a first height defines an outer horizontal width (A) and, in a second height, said at least one quayside support leg defines an inner horizontal width (B') wherein said inner horizontal width (B') in said second height is greater than said outer horizontal width (A) of said quayside support leg in said first height, wherein the first height is below the second height.

2. A cargo crane according to claim 1, wherein said container lifting means, said trolley and said boom are configured to transfer containers to or from a ship by means of passing said containers vertically over a portion of said at least one quayside support leg.

3. A cargo crane according to claim 2, wherein said at least one quayside support leg define an opening allowing for long side passage of a container.

4. A cargo crane according to claim 2, wherein said quayside support leg constitutes a pair of quayside supporting legs.

5. A cargo crane according to claim 2, wherein said at least one landside support leg is arranged to travel on an elevated rail, by means of at least one bogie, characterized in that said elevated rail is elevated to a height allowing for passage of cargo vehicles carrying cargo underneath said elevated rail.

6. A cargo crane according to claim 1, wherein said at least one quayside support leg define an opening allowing for long side passage of a container.

7. A cargo crane according to claim 6, wherein said quayside support leg constitutes a pair of quayside supporting legs.

8. A cargo crane according to claim 6, wherein said at least one landside support leg is arranged to travel on an elevated rail, by means of at least one bogie, characterized in that said elevated rail is elevated to a height allowing for passage of cargo vehicles carrying cargo underneath said elevated rail.

9. A cargo crane according to claim 1, wherein said quayside support leg constitutes a pair of quayside supporting legs.

10. A cargo crane according to claim 1, wherein said at least one landside support leg is arranged to travel on an elevated rail, by means of at least one bogie, characterized in that said elevated rail is elevated to a height allowing for passage of cargo vehicles carrying cargo underneath said elevated rail.

11. A cargo crane according to claim 1, wherein said container is a 40 or 45 foot container.

12. A cargo crane according to claim 1, wherein said container lifting means, said trolley and said boom are configured to transfer containers to or from a ship by means of passing said containers vertically over a portion of said at least one quayside support leg.

13. A cargo crane according to claim 1, wherein said opening allows for long side passage of a container.

14. A cargo crane according to claim 1, wherein said quayside support leg constitutes a pair of quayside supporting legs.

15. A pair of cargo cranes for transferring containers to and from a ship birthed alongside a quay, each of said cargo cranes includes:

at least one quayside support leg directly supported by a bogie arranged to travel on a rail, at least one landside support leg directly supported by a bogie arranged to travel on a rail, a boom configured to extend over a ship birthed alongside a quay, a trolley displaceably connected to said boom, and container lifting means connected to said trolley, wherein said quayside support leg of a first crane of the pair of cargo cranes defines an opening allowing for long side passage of a container in a first height and said quayside support leg of a second crane of the pair of cargo cranes defines an opening allowing for long side passage of a container in a second height characterized in that said first height and said second height are chosen such that said set of cargo cranes may approximate each other such that said set of cargo cranes are able to simultaneously transfer containers to and from two side-by-side neighboring container holds of a containership.

16. A set of cargo cranes according to claim 15, wherein a distance between boom center lines of said first cargo crane and said second cargo crane is less than 14 meters.

17. A set of cargo cranes according to claim 15, wherein said openings define passageways for containers wherein a container passing through said opening in said first crane is passed over a portion of said quayside support leg of said second crane and vice versa.

18. A set of cargo cranes according to claim 15, wherein said landside support legs and said quayside support legs of each of said cranes are, by means of said bogies, arranged to travel on a total of four dedicated rails extending substantially parallel to said quay.

19. A set of cargo cranes according to claim 18, wherein landside support legs of said set of cranes are configured to travel on a rail elevated to a height allowing for passage of cargo vehicles carrying cargo underneath said elevated rail.

20. A cargo crane for transferring containers to and from a ship birthed alongside a quay, said cargo crane includes:

at least one quayside support leg directly supported by a bogie arranged to travel on a rail, at least one landside support leg directly supported by a bogie arranged to travel on a rail, a boom configured to extend over a ship birthed alongside a quay, a trolley displaceably connected to said boom, and container lifting means connected to said trolley, wherein said at least one quayside support leg in a first height defines an outer horizontal width (A) and an inner horizontal width B that defines an opening allowing for long side passage of a container in a second height, said at least one quayside support leg defines an inner horizontal width (B') of the opening, and wherein said inner horizontal width (B') of said opening in said second height is greater than said outer horizontal width (A) of said quayside support leg in said first height.

* * * * *